US006901150B1

(12) United States Patent
Anciant

(10) Patent No.: US 6,901,150 B1
(45) Date of Patent: May 31, 2005

(54) PERMANENT MAGNET ACTUATOR WITH ELECTRIC EXCITATION COIL, ESPECIALLY LOUDSPEAKER AND MOBILE TELEPHONE

(75) Inventor: Marc Anciant, La Garenne Colombes (FR)

(73) Assignee: Sagem, SA, Paris (FR)

( * ) Notice: Subject to any disclaimer, the term of this patent is extended or adjusted under 35 U.S.C. 154(b) by 136 days.

(21) Appl. No.: 09/691,684

(22) Filed: Oct. 18, 2000

(30) Foreign Application Priority Data

Oct. 19, 1999 (FR) ..... 99 12996

(51) Int. Cl.[7] ..... H04R 24/00
(52) U.S. Cl. ..... 381/401; 381/400
(58) Field of Search ..... 381/400–402, 381/406–410, 412, 421, 422, 419, 420, 430, 414; 379/443, 444, 52

(56) References Cited

U.S. PATENT DOCUMENTS

| | | | | | |
|---|---|---|---|---|---|
| 2,727,949 | A | * | 12/1955 | Lokkesmoe | 381/117 |
| 3,881,074 | A | * | 4/1975 | Kawamura | 335/231 |
| 4,132,861 | A | * | 1/1979 | Frieder et al. | 381/335 |
| 4,243,839 | A | * | 1/1981 | Takahashi et al. | 381/96 |
| 4,427,845 | A | | 1/1984 | Yoshida | 381/94.9 |
| 4,529,846 | A | * | 7/1985 | Freeman et al. | 381/369 |
| 5,448,620 | A | * | 9/1995 | Gershkovich et al. | 455/552 |
| 5,602,931 | A | * | 2/1997 | Geisenberger | 381/400 |
| 5,717,775 | A | * | 2/1998 | Sakamoto et al. | 381/400 |
| 5,757,945 | A | * | 5/1998 | Sakamoto | 381/400 |
| 5,937,076 | A | | 8/1999 | Tanabe et al. | |
| 6,175,637 | B1 | * | 1/2001 | Fujihira et al. | 381/412 |
| 6,359,996 | B1 | * | 3/2002 | Ohashi | 381/401 |
| 6,373,958 | B1 | * | 4/2002 | Enomoto et al. | 381/406 |
| 6,404,896 | B1 | * | 6/2002 | Yoo et al. | 381/401 |
| 6,542,617 | B1 | * | 4/2003 | Fujihira | 381/400 |

FOREIGN PATENT DOCUMENTS

| | | | | |
|---|---|---|---|---|
| JP | 03064387 | | 3/1991 | |
| JP | 06014393 | A1 * | 1/1994 | 381/412 |
| WO | PCT/US94/00020 | | 1/1994 | |
| WO | WO 94/16536 | * | 7/1994 | 381/199 |

* cited by examiner

*Primary Examiner*—Curtis Kuntz
*Assistant Examiner*—P. Dabney
(74) *Attorney, Agent, or Firm*—Patterson, Thuente, Skaar & Christensen, P.A.

(57) ABSTRACT

To reduce the effects of disturbing electromagnetic effects on a loudspeaker of a mobile telephone, the loudspeaker is provided with a compensation coil in addition to an excitation coil. The compensation coil is series-connected with the excitation coil. However, it is dispensed of the need for playing a driving role by being bonded to the permanent magnet of the loudspeaker: It is shown that the harmful effects are reduced without stopping the loudspeaker from working.

9 Claims, 2 Drawing Sheets

PERMANENT MAGNET ACTUATOR WITH ELECTRIC EXCITATION COIL, ESPECIALLY LOUDSPEAKER AND MOBILE TELEPHONE

BACKGROUND OF THE INVENTION

1. Field of the Invention

An object of the present invention is a permanent magnet actuator with electric excitation coil, especially a mobile telephone loudspeaker or, again, a personal microcomputer loudspeaker. The aim of the invention is to make the motion of such an actuator insensitive to external magnetic disturbances.

2. Description of the Prior Art

Mobile telephones use loudspeakers that are naturally placed towards the top of the machine, so as to correspond to the position of a listener's ear. The electromagnetic radiation antenna of a mobile telephone such as this is also placed towards the top of the instrument. In practice, an electric printed circuit forming an electronic board is placed so as to be facing the loudspeaker and conveys transmission signals up to this antenna. When the mobile telephone is put into service and recognized by a base station, this mobile telephone sends out protocol signals, with rated power, on the beacon frequency of thus base station, before this base station assigns it a lower value of transmission power, related to its distance. When the mobile telephone is far from the base station, the transmission power is furthermore permanently a rated power value.

The electrical signal corresponding to this protocol-based acknowledgement, like all the signals exchanged, are contained in 577-microsecond time windows in eight-window frames whose duration is 4.615 milliseconds (in GSM TDMA—Time Division Multiple Access—mode). The output amplifier of the mobile telephone is therefore the site of a pulsed consumption with a frequency of the order of 217 Hz. This high consumption generates an electromagnetic noise that gets propagated in the pack of the mobile telephone and, in certain cases, leads to a parasitic mechanical excitation of the diaphragm of the mobile telephone loudspeaker. The user then hears a rumbling noise, at least at the time of recognition. This noise is troublesome.

The disturbance observed is not a disturbance of the audio signal that is fed into the loudspeaker (even if this source also plays a part), but an induction of current in the coil of the loudspeaker. This induction of current has the effect of placing the coil and diaphragm of the speaker into motion and therefore of producing noise. This noise is called burst noise with reference to the pulse envelopes of the power values consumed in the temporal windows. Thus, when the loudspeaker is short-circuited on itself, without any electrical contact with the printed circuit, the burst noise is perceived in the same way. In certain mobile telephones, the problem is less critical because the loudspeaker is relatively distant from the printed circuit on the electronic card. Inasmuch as it is difficult to foresee the structure of the magnetic field radiated by an electronic board, this type of problem can be detected only when the loudspeaker is integrated into the mobile unit, even if it is known that it is always preferable to move the loudspeaker away to the maximum distance from the high-power radio tracks.

In normal operation, a voltage U(t) is applied to the terminals of the loudspeaker. The excitation coil of this loudspeaker is then crossed by a current i. This coil is furthermore immersed in a static magnetic field $B_0$ created by a magnet of the loudspeaker. The result thereof is a force F applied to the coil, called the Laplace force, whose value is given by: $F=ilB_0$, l being the wire length of the coil. This force is sometimes positive and sometimes negative depending on the direction in which the current travels in the coil. Since the coil is rigidly fixed to the diaphragm of the loudspeaker, the assembly formed by the coil plus the diaphragm is thus put into motion.

In disturbed mode, the excitation voltage originates differently. An external electromagnetic field $B_e(t)$, variable in time, encompasses the coil of the loudspeaker and creates a magnetic flux $Ø_e$ through this coil. The value of this flux is given by $Ø_e(t)=NSB_e(t)$, where N is the number of turns of the coil and S is the surface area of a turn. It is the variations in time of this flux that generate an electromotive force (a voltage) e at the terminals of the coil according to the relationship $e=-dØ_e/dt$. The voltage e faces a relatively low electrical resistance (the electrical resistance of the loudspeaker (R=8 Ω) in series with the internal resistance of the amplifier (r≈8 Ω)). Hence a non-negligible current crosses the coil. This activates the diaphragm according to the same principle as the one referred to here above. An approach in which a high resistance is series-connected with the loudspeaker has the merit of eliminating the perceptible effects of such a noise. However, it has the drawback of leading to an audio supply that is oversized and consumes power.

It is an object of the invention to overcome the above-mentioned drawback by combating one ill with another ill. It is known indeed that a voltage +e appears at the terminals of the coil when it is plunged into the disturbing field $B_e(t)$. In the invention, a second coil, identical to the first one, is then placed in the vicinity of the first one, resulting in the appearance, in the same way, of a voltage +e at the terminals of this second coil What remains to be done then is to achieve a series-connection of the two coils, but in opposition (namely with opposite directions of winding), so that the two voltages get cancelled out. If, because of the disturbance $B_e(t)$, no voltage is applied to the terminals of the two coils, then no corresponding current flows therein. If no current flows therein, then no mechanical force is exerted on the coil and, therefore, because of the disturbance, the diaphragm of the loudspeaker does not move.

SUMMARY OF THE INVENTION

An object of the invention therefore is an actuator comprising a permanent magnet, an actuated part and a first electrical coil for mechanical excitation that is movable with respect to the magnet and fixed to the actuated part, the actuator comprising a second electrical coil, wound in series with the first coil but wound so as to produce a counter electromotive force that is the reverse of the force produced by the first coil when they are both subjected to one and the same temporally variable electromagnetic or magnetic field.

BRIEF DESCRIPTION OF THE DRAWINGS

The invention will be understood more clearly from the following description and the figures that accompany it. These figures are given purely by way of an indication and in no way restrict the scope of the invention. Of these figures.

MORE DETAILED DESCRIPTION

Figure 1:
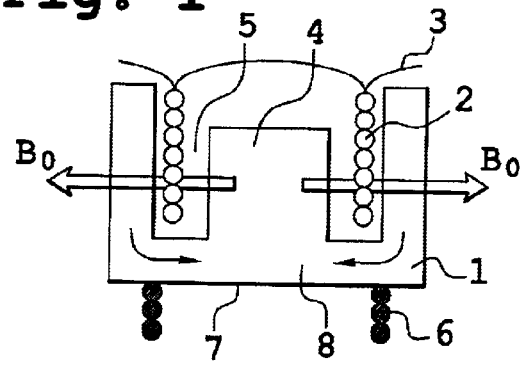
FIGS. 1 to 3*b* show three variants of an actuator according to the invention, applied to the making of a loudspeaker, especially a mobile telephone loudspeaker.

FIG. 1 shows an actuator according to the invention. This actuator, in the example shown, can be used to make a loudspeaker, especially a mobile telephone loudspeaker. This actuator has a permanent magnet 1, a first coil 2, and an actuated part 3, herein a diaphragm 3 of a loudspeaker. The diaphragm 3 is fixed to the coil 2, especially by the bonding of a central ring of this diaphragm 3 to an upper edge of this coil 2. This coil 2 is placed around a central shaft 4 of the magnet 1. The coil 2, and the diaphragm 3 are mobile with respect to the central shaft 4, in a direction perpendicular to a radial field $B_0$ prevailing in an air gap 5 of the magnet 1. The actuator of the invention is chiefly characterized by the presence of a second coil 6 series-connected with the coil 2 in such a way that it produces a counter electromotive force which is the reverse of the one produced by the first coil 2 when they are both subjected to one and the same temporally variable electromagnetic or magnetic field. The way to set up an electrical series connection of the two coils in practice shall be seen further below. In one example, the two coils 2 and 6 each have between 40 and 50 turns. The dimensions of the surfaces S of the turns of these coils 2 and 6 and their numbers N are such that N2*S2=N6*S6.

In one example, the temporally variable electromagnetic field is a disturbing field $B_e(t)$. It is, for example, the field produced by conductive tracks etched on a printed circuit of an electronic board placed in the vicinity of the actuator, or even bearing the actuator. This disturbing field may be oriented, for example, perpendicularly to the field $B_0$.

In the examples shown, the first and second coils are coaxial. However, this preferred mode is not a necessity.

In normal operation, the two series-connected coils 2 and 6 are subjected to a voltage U(t) of a useful signal whose states should be followed by the actuator. In the invention, the reversal of connection is designed so that the current flowing in the two coils has a rotational direction different in one coil from that in the other. If the two coils are rigidly joined to each other and are immersed in the driving field $B_0$, the mechanical forces exerted on the coils can then work against each other and the diaphragm or the lever 3 will not be put into motion under the effect of the voltage U(t). There are then several approaches that can be used to produce a motion. Either the coils will be separated from each other (FIGS. 1 and 2), or they will be fixed to each other (FIGS. 3*a* and 3*b*). When they are separated from each other, only one of them is a driving coil to drive the diaphragm 3. When they are rigidly fixed, the magnet is modified.

In the former case, shown in FIG. 1, in addition to being separated, the second coil 6 is taken out of the driving field $B_0$. For example, the coil 6 is bonded to the base 7 of the magnet 1. Only the coil 2 is a driving coil because, in the magnet 1, the field passes essentially through the gap 5. It gets looped to the base 8 of the magnet 1. The disturbing field tends to create a current in the reverse direction in these two coils, which is not possible given their mode of connection. Consequently, there is no disturbing current set up that might be due to a disturbing field of this kind, and the diaphragm 3 is subjected only to useful motions reproducing the voltage U(t).

In this variant, there is a risk, however, of a shortcoming in the efficiency of the system. Indeed, in order that the compensation with respect to the disturbing field may be perfect, it is preferable that the two coils 2 and 6 should be immersed in a disturbing magnetic field in the same way. This is not quite the case because the coils 2 and 6 are distant from each other. It can happen, for example, that leakages from the disturbing field will pass between the two coils, in the base 8.

Figure 2:
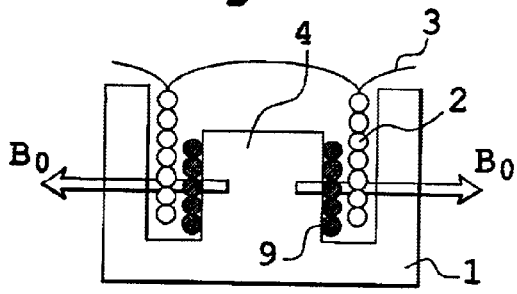
Figure 3A:
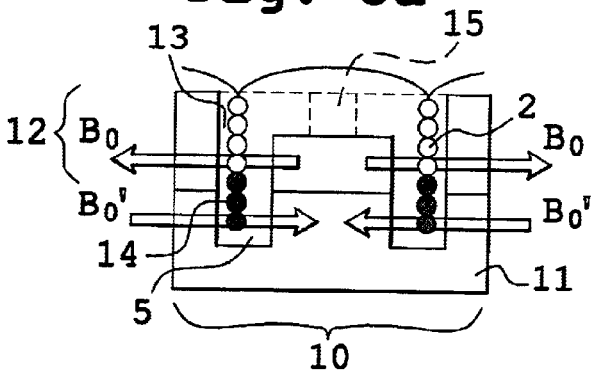
Figure 3B:
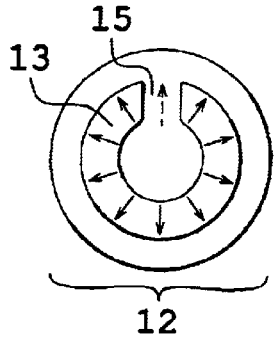

In this case too, a second approach, shown in FIG. 2, makes it possible, conversely, to let a second coil 9 be immersed in the field $B_0$, and especially in a disturbing field identical to the disturbing field perceived by the coil 2. Consequently, the compensation is perfect. In this second approach, the second coil 9 is fitted into the first coil 2. In order that it may be mechanically dissociated from the coil 2, the coil 9 is preferably bonded around the shaft 4 of the magnet 1 (or against the base 8) to prevent it from moving. Here too, the two coils are separated and only the first coil plays a driving role.

In the latter case, a double magnet 10 is used. This double magnet 10 has a bottom part 11 of the same type as the magnet 1, and a complementary part 12 (seen in a top view in FIG. 3*b*). The part 12 has a central shaft linked by a field return bracket 15 to a peripheral ring. The bracket 15 is thin and allows the mobile coil to fluctuate normally. When they are stacked and bonded, the two parts 11 and 12 have a contiguous air gap with a same dimension on which the coils float. However, the direction of the driving field $B_0$ in the air gap 5 of the part 11 has a direction opposite to the direction of the field $B_0'$ in the air gap 13 of the complementary part The field in the upper part 12 is radial divergent and, in the lower part 11, the field is convergent radial or vice versa. The two coils then have a combined driving role for currents that travel through them with opposite directions of rotation. However, the turns of the second coil 14, when they penetrate the gap of the upper part 12, prompt a contrary effort on the diaphragm. This is not troublesome inasmuch as the current in the active strands is sufficient to continue moving the diaphragm 3. If need be, a space without a conductive strand is made between the two coils. The height of this space corresponds to the expected play of the coils under the effect of the voltage U(t). This approach furthermore has the advantage wherein the industrial-scale manufacture of the total coil 2-14 and its assembly in the actuator are identical to those of the prior art.

Figure 4:
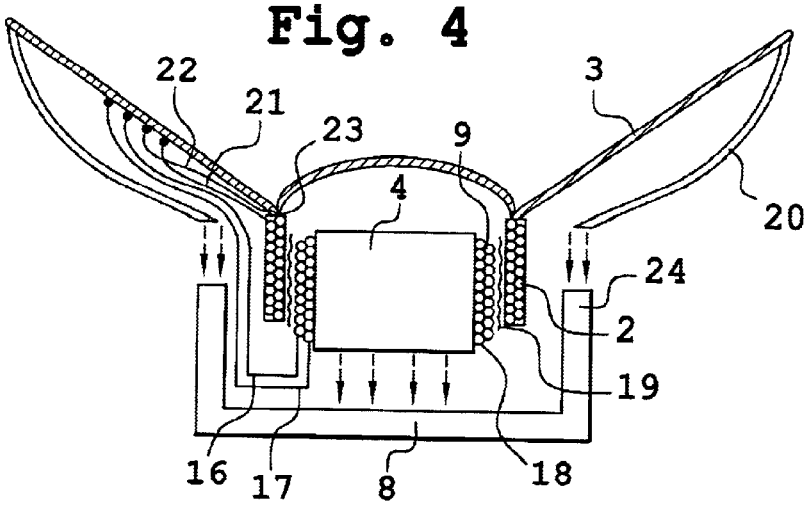
FIG. 4 shows details of the making of the second preferred variant of the invention.

FIG. 4 gives a detailed view of the making of a loudspeaker with the variant of FIG. 2. The operation begins with the winding and bonding of a coil 9 around a shaft 4 of a permanent magnet. This winding is done in at least two layers so that the two conductive strands 16 and 17 of this winding reach, preferably as a pair, a first end 18 of the coil 9. Then a sliding wall 19 is placed around the coil 9, for example in the form of a polytetrafluoroethylene sleeve, or if need be by covering the outer part of the coil 9 with a layer of paraffin wax. Then, one end of a first coil 2 is mounted against a vibrating diaphragm 3. An outer rim of this diaphragm 3 is fixed to a peripheral structure 20. The winding of the coil 2 is also done in at least two layers so that the two conductive strands 21 and 22 of this winding preferably lead to a second end 23 of the coil. The strands 21 and 22 are bonded to the back of the diaphragm 3. The shaft 4 and the coil 9 are then introduced into the coil 2 so that the ends 18 and 23 are opposite each other. The strands 16 and 17 are then folded around the coil 2, but with sufficient clearance, before being themselves bonded, at least partially, to the back of the diaphragm 3, at a place where the connection of the strand 17 to the strand 21 is possible. The assembly will then be powered between the strands 16 and 22. The assembly is finally mounted by hooking the structure 20 to the peripheral upright foot 24 of the magnet 1. At this time, the shaft 4 is bonded to the base of the magnet.

Thus, with a structure having two series-connected coils, a solution is provided in which the ends of the strands of the two coils are bonded to the diaphragm of the loudspeaker. Should one of the strands of one coil be connected to one of the strands of another coil, the result will be a technical effect of compensation of induced electromotive forces. In this case, the series connection of the coils (which may be done separately) is obtained by at least partially bonding the strands of the ends of the two windings to (the back of) the diaphragm, at a place where the connection (for example by a switch) of a strand of one coil to another is possible. Thus, when these strands are powered, either they are powered in series (and the compensation comes into play), or they are powered separately or else not even one of them is powered. Such a faculty is especially valuable for the differentiation, with a mobile telephone, between a "hands free" listening mode and a mode of listening with the telephone at the ear.

Figure 5:
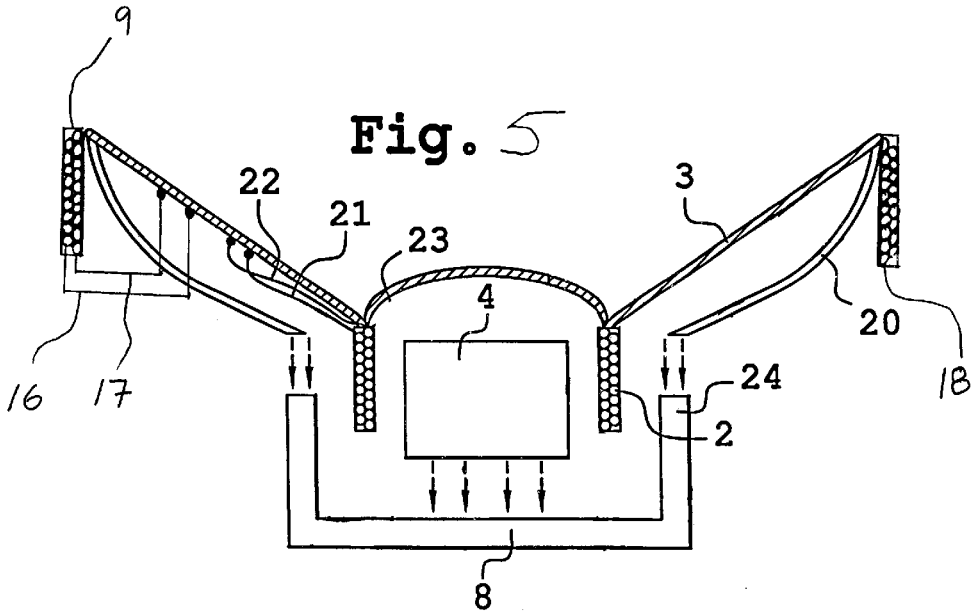
FIG. 5 shows a variant of the loudspeaker shown in FIG. 4.

The fact of having the ends of the strands of the two coils bonded to the diaphragm makes this connection particularly simple, especially if the second coil, namely the one not subjected to the radial field, is rigidly joined to the diaphragm, for example to the outer periphery of the diaphragm, at the place where the diaphragm is held on the loudspeaker. In FIG. 5 one example is shown, where the compensation coil is made precisely on the outer rim of this diaphragm, bonded against the diaphragm or against the peripheral structure 20, at the place where this peripheral structure is attached to the diaphragm. It is then easy to provide for an additional selection-switching operation linked to these connection points of the strands on the diaphragm. Preferably, these connection points are placed close to this outer periphery of this diaphragm.

It must be noted that the electrical resistance of the loudspeaker will be double (R=16 Ω instead of R=8 Ω), since two coils are series connected. In this case, the internal impedance of the coil-powering amplifier can be modified accordingly. Preferably, the second coil 6 or the second coil 9 will be made with conductive strands having larger diameters. Their electrical resistance will be reduced accordingly. On the driving plane, no problem of inertia need be feared because, in these latter variants, the second coils 6 and 9 are fixed.

What is claimed is:

1. A mobile telephone loudspeaker comprising a permanent magnet and a diaphragm, the mobile telephone loudspeaker having only a first electrical coil and a second electrical coil, wherein the first electrical coil for mechanical excitation is movable with respect to the magnet and fixed to the diaphragm, and wherein the second electrical coil is operably electrically coupled in series with the first coil so as to produce a counter electromotive force that is the reverse of the force produced by the first coil when they are both subjected to one and the same temporally variable electromagnetic or magnetic field, the second coil being held fixed with respect to the magnet.

2. A mobile telephone loudspeaker according to claim 1, wherein the second coil is separated mechanically from the first coil by a sliding wall.

3. A mobile telephone loudspeaker according to claim 1, wherein the permanent magnet produces a magnetic field $B_0$ and includes an air gap through which the magnetic field $B_0$ extends and wherein the second coil is placed outside the air gap.

4. A mobile telephone loudspeaker according to claim 1, wherein the permanent magnet produces a magnetic field $B_0$ and includes an air gap through which the magnetic field $B_0$ extends and wherein the second coil is placed inside the air gap.

5. A mobile telephone loudspeaker according to claim 1, wherein the second coil is fitted into the first coil, the first and second coils each have a pair of power supply strands issuing side by side, the first coil going up to an end opposite the end of the second coil to which the pair of strands of this second coil goes up to.

6. A mobile telephone loudspeaker according to claim 5, wherein the strands of the two coils are bonded to the diaphragm.

7. A mobile telephone loudspeaker according to claim 5, wherein the ends of the strands of the two coils are bonded to the back of the diaphragm or a peripheral structure.

8. A mobile telephone loudspeaker according to claim 1, wherein the second coil is fixed to the outer periphery of the diaphragm.

9. A mobile telephone loudspeaker including a permanent magnet and a diaphragm, the mobile telephone loudspeaker having only a first mechanical excitation electrical coil, mobile relative to the magnet and fixed to the diaphragm, and a second electrical coil, wherein the second coil is wound in series with the first coil so as to produce a counter electromotive force opposite to that produced by the first coil when they are both subjected to a same electromagnetic or time variable magnetic field, by the fact that the second coil is kept fixed relative to the first coil, and by the fact that the two coils are placed within the magnetic field of the magnet opposite a zone of the air-gap of this magnet in which the field undergoes a reversal of orientation depending on whether it passes through the first coil or the second coil.

* * * * *